United States Patent [19]

Sorenson

[11] 4,454,400

[45] Jun. 12, 1984

[54] SWITCH CONSTRUCTION

[75] Inventor: Richard W. Sorenson, Avon, Conn.

[73] Assignee: Carlingswitch, Inc., West Hartford, Conn.

[21] Appl. No.: 423,219

[22] Filed: Sep. 24, 1982

Related U.S. Application Data

[63] Continuation-in-part of Ser. No. 328,828, Dec. 9, 1981, Pat. No. 4,347,417.

[51] Int. Cl.[3] ..... H01H 9/16

[52] U.S. Cl. ..... 200/315

[58] Field of Search ..... 200/315

[56] References Cited

U.S. PATENT DOCUMENTS

| | | | |
|---|---|---|---|
| 2,494,560 | 1/1950 | Kaupp | 200/315 |
| 3,294,945 | 12/1966 | McLaughlin | 200/315 |
| 3,643,051 | 2/1972 | Foley | 200/275 |
| 3,732,388 | 5/1973 | Taylor | 200/315 |
| 3,743,805 | 7/1973 | Guinan | 200/315 |
| 4,101,749 | 7/1978 | Josemans et al. | 200/315 |

FOREIGN PATENT DOCUMENTS

| | | | |
|---|---|---|---|
| 1293886 | 4/1969 | Fed. Rep. of Germany | 200/315 |
| 2149498 | 4/1973 | Fed. Rep. of Germany | 200/315 |
| 2447378 | 4/1976 | Fed. Rep. of Germany | 200/315 |
| 2556461 | 6/1977 | Fed. Rep. of Germany | 200/315 |

*Primary Examiner*—John W. Shepperd

*Attorney, Agent, or Firm*—McCormick, Paulding & Huber

[57] ABSTRACT

A plastic switch actuator is fitted with a spring so as to impart sliding and rocking motion to a movable contact by virtue of direct engagement between spring and element. The actuator may be slidably or pivotally supported in the switch case and has a depending integral portion received in an opening of the element but it is the spring which keeps the element in contact with the fixed switch contacts. Other embodiments provide for illuminating the rocker in the miniature switch through a resistor also provided in the rocker itself, and switched on and off by movement of the rocker.

12 Claims, 3 Drawing Figures

SWITCH CONSTRUCTION

This application is a continuation-in-part of a copending application having the same title and inventor filed Dec. 9, 1981 under Ser. No. 328,828. The said copending application is a division of since issued U.S. Pat. No. 4,347,417 which application is incorporated by reference herein.

The general purpose of the present invention is to provide a unique switch construction having a minimum number of component parts, which switch construction also permits a lamp to be incorporated in the movable actuator portion of the switch and to be energized either through a spring associated with the actuator, instead of through a resistor element connected selectively through a spring directly to a fixed contact of the switch as shown in said copending application. This resistor preferably comprises a simple wire wound type with metal end caps and does not include lead wires and/or a plastic covering etc. Therefor, the resistor element is smaller than these plastic covered types and better suited to use in the unique switch construction disclosed herein.

These unique features can be provided in a switch base of double pole configuration to further expand the illumination possibilities for the externally visible portion of the actuator. The use of relatively inexpensive light weight springs to connect one or more or the lamp leads to a fixed terminal in the base eliminates soldering and the like. In addition, the lamp or bulb is free to move with the movable actuator in such a way that one or more such springs serve as lost motion conductive elements to minimize the degree of flexing and bending of lamp lead wires characteristic of prior art switch constructions. Where the metal resistor is provided in the actuator it is possible to provide separate switching for the lamp.

Figure 1:
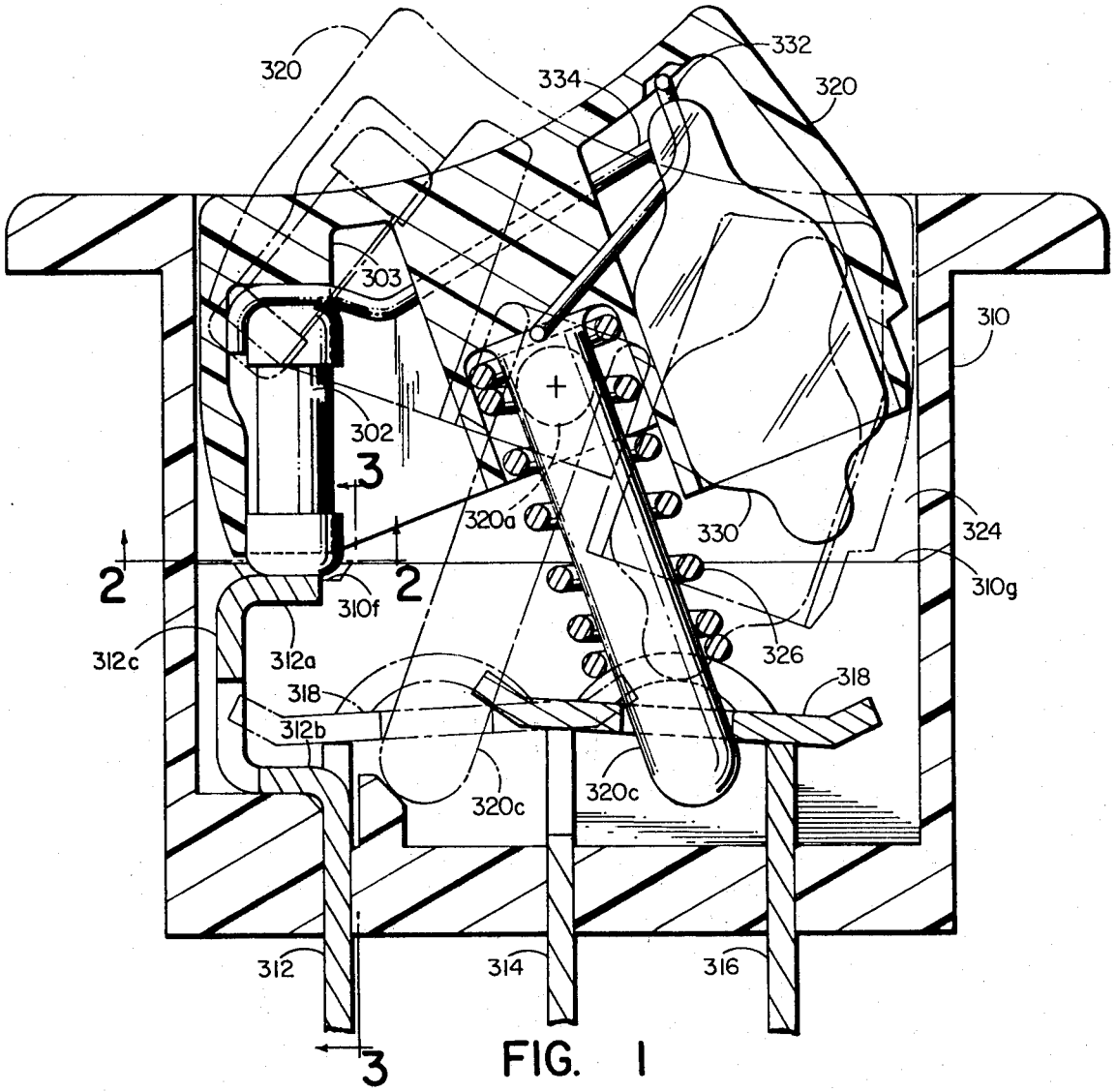
FIG. 1 is a vertical sectional view through an improved switch having certain features common to that depicted in said copending application and illustrates the actuator in a first and second position, the latter being shown in broken lines.
Figure 2:
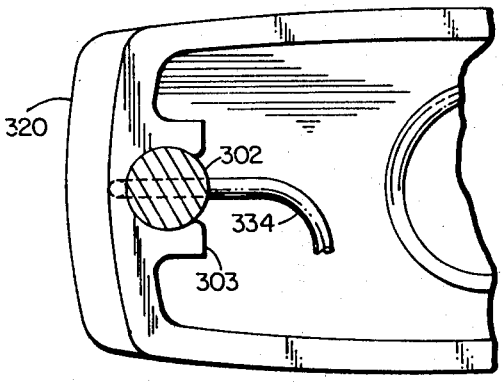
FIG. 2 is a sectional view taken on the line 2—2 of FIG. 1.

The advantages described in my copending application are achieved in the FIG. 1 switch as a result of the uniquely shaped fixed contact 312 and the fact that the upper end of 312*a* of fixed contact 312 defines a conductive abutment that engages the resistor 302 when the rocker 320 is in the solid line position shown in FIG. 1. Thus, resistor 302 has a conductive abutment end portion that selectively switches the resistor and lamp "on" and "off" as a function of the position for rocker 320.

Figure 3:
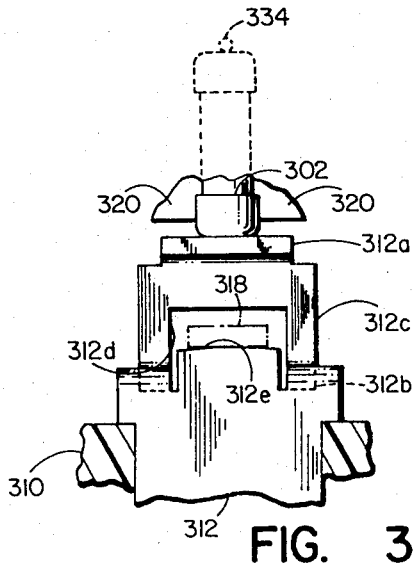
FIG. 3 is a sectional view taken on the line 3—3 of FIG. 1.

Contact 312 has a planar lower portion projecting through the bottom wall of the switch case, as do the other fixed contacts 314 and 316. Thus, these contacts 312, 314 and 316 are quite like those described above with reference to numerals 212, 214 and 216 in FIGS. 5 and 6 of said copending application. However contact 312 has a C-shaped upper portion with spaced lges 312*a* and 312*b* integrally connected by a portion 312*c* which is offset to allow the end of movable contact 318 to enter an opening 312*d* in this portion 312*c* as best shown in FIG. 3. A raised land or tab 312*e* comprises an extension of the lower blade portion of fixed contact 312 and serves as the support for the left hand end of movable contact 318 when the rocker is moved to the broken line or "off" position. In the "on" condition shown in solid lines in FIG. 1, the resistor and lamp are switched into a live electrical circuit.

It will be apparent that the geometry of this FIG. 1 switch is such that a fixed terminal, such as that shown at 316 can be substituted for the C-shaped terminal 312 when no rocker lamp, or associated resistor is required. Thus, the rocker 320 can be utilized in the switch case 310 to provide a non-illuminated rocker switch, and it will also be apparent that a center off switch can also be provided by including a different configuration for the center contact 314, and the movable contact 318, as shown in the parent applications referred to in the opening paragraph of this application for patent.

I claim:

1. An electric switch comprising a case having a cavity with sides and a bottom wall, fixed switch contacts provided in said bottom wall, said case defining actuator support regions, and actuator supported by said case regions for movement between first and second limit positions, a lamp provided in said actuator, a resistor circuit having a conductive abutment portion in said actuator, a movable contact slidably received inside said cavity for movement across the upper ends of certain of said fixed contacts in response to said actuator movement, electrically conductive lost motion means between said actuator and said movable contact to urge the latter toward the upper ends of certain fixed contacts, at least one fixed contact having its upper end spaced above said upper ends of said certain fixed contacts and defining a conductive abutment for engaging said conductive abutment portion of said resistor circuit in said actuator only when the latter is in said first limit position said one fixed contact also having a portion below said conductive abutment for engagement with said movable contact in said second limit position for said actuator.

2. The switch according to claim 1 wherein said upper end of said one fixed contact has a C-shaped offset portion with the upper leg of the C-shape defining said conductive abutment.

3. The switch according to claim 2 wherein said resistor circuit includes a resistor provided in said actuator and a conductive lead connecting one end of said resistor to said lamp, another end of said resistor which is opposite said end connected to said lamp by said lead, said one resistor end defines said portion of said resistor circuit for engagement with said conductive abutment when said actuator is in its first limit position.

4. The switch according to claim 3 wherein said conductive lost motion means comprises a metal spring in contact with said movable contact, a depending portion of said actuator for retaining said spring, and a second conductive lead connecting said lamp to an upper end of said spring whereby said first actuator limit portion causes said movable contact to bridge said certain fixed contacts and to provide a closed circuit for said lamp and resistor through said one fixed contact as a result of engagement between the upper end thereof and said one end of said resistor.

5. The switch according to claim 4 wherein said one fixed contact also includes a tab portion spaced below the upper end and defined above said lower leg of said C-shaped offset portion, said tab adapted to support said movable contact element in said second position of said actuator.

6. The switch according to claim 1 wherein said resistor circuit includes a resistor, one end of said resistor defining said portion of said circuit for engaging said conductive abutment.

7. The switch according to claim 1 wherein said actuator support regions comprise openings in said case side walls, and wherein said actuator has projecting portions pivotally supporting said actuator for movement between said first and second limit positions.

8. The switch according to claim 7 wherein said conductive lost motion means comprises a coil compression spring acting between a portion of said actuatorbelow its axis of pivotal movement and said movable contact, said actuator having a depending portion for retaining said spring so that it comprises the sole lost motion connector therebetween.

9. The switch according to claim 8 wherein said upper end of said one fixed contact has a C-shaped offset portion with the upper leg of the C-shape defining said conductive abutment.

10. The switch according to claim 9 wherein said resistor circuit includes a resistor provided in said actuator and a conductive lead connecting said resistor to said lamp, one end of said resistor to said lamp, one end of said resistor which is opposite said end connected to said lamp by said lead, which said one resistor end defines said portion of said resistor circuit for engagement with said conductive abutment when said actuator is in its first limit position.

11. The switch according to claim 10 further including a second conductive lead connecting said lamp to an upper end of said spring, said actuator depending portion engaging said movable contact to cause it to bridge said certain fixed contacts and to close said circuit for said lamp and resistor through engagement between said upper end of said one fixed contact and said resistor.

12. The switch according to claim 8 wherein said resistor circuit includes a resistor, one end of said resistor defining said portion of said circuit for engaging said conductive abutment.

* * * * *